US008257044B2

(12) United States Patent
Hayasaka et al.

(10) Patent No.: US 8,257,044 B2
(45) Date of Patent: Sep. 4, 2012

(54) STEAM TURBINE ROTOR BLADE ASSEMBLY

(75) Inventors: Yasushi Hayasaka, Mito (JP); Hajime Toriya, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1015 days.

(21) Appl. No.: 12/207,901

(22) Filed: Sep. 10, 2008

(65) Prior Publication Data

US 2009/0097980 A1 Apr. 16, 2009

(30) Foreign Application Priority Data

Sep. 11, 2007 (JP) ..... 2007-234858

(51) Int. Cl.
*F01D 5/30* (2006.01)
*F01D 5/22* (2006.01)

(52) U.S. Cl. ..... 416/189; 416/219 R

(58) Field of Classification Search ..... 416/189, 416/219 R
See application file for complete search history.

(56) References Cited

U.S. PATENT DOCUMENTS

| | | | | |
|---|---|---|---|---|
| 2007/0207034 | A1 | 9/2007 | Nogami et al. | |
| 2008/0286109 | A1 * | 11/2008 | Keith et al. | 416/239 |
| 2010/0041322 | A1 * | 2/2010 | Moser et al. | 451/75 |
| 2010/0290917 | A1 * | 11/2010 | Wilson et al. | 416/226 |
| 2010/0329888 | A1 * | 12/2010 | Nadvit et al. | 416/97 R |

FOREIGN PATENT DOCUMENTS

| | | |
|---|---|---|
| JP | 57-076208 | 5/1982 |
| JP | 57-158901 | 10/1982 |
| JP | 58-176402 | 10/1983 |
| JP | 63-230909 | 9/1988 |
| JP | 63-150002 | 10/1988 |
| JP | 11-148305 | 6/1999 |
| JP | 2000-204901 | 7/2000 |
| WO | 03/014529 A1 | 2/2003 |

* cited by examiner

*Primary Examiner* — David S Blum
(74) *Attorney, Agent, or Firm* — Mattingly & Malur, PC

(57) ABSTRACT

The present invention is a steam turbine rotor blade assembly including: an airfoil; a shroud provided at a tip of the airfoil; a blade root (dovetail) projecting toward a radially internal circumferential side of a turbine rotor and fitted to a root attachment provided on an outer circumferential portion of the turbine rotor; a platform provided between the airfoil and the blade root; a pin provided between the blade root and the root attachment; a bore formed between respective surfaces of the shrouds facing each other and included in the respective adjacent rotor blades; and a bar-like member provided in the bore.

11 Claims, 7 Drawing Sheets

STEAM TURBINE ROTOR BLADE ASSEMBLY

BACKGROUND OF THE INVENTION

1. Field of the Invention

The present invention relates to a steam turbine rotor blade and an assembly using the same.

2. Description of the Related Art

Steam turbine rotor blades are subjected to a large centrifugal force resulting from rotation of a rotor and to a vibratory load due to steam. Therefore, there are various contrives in the structures, particularly, in an implanted portion of an airfoil and in a shroud disposed at a tip of the airfoil.

More specifically, to reduce response stress resulting from a steam vibratory load, an integral shroud structure in which respective tips of rotor blades are brought into contact with each other is proposed. Another structure in which a shim or pin is inserted between the adjacent surfaces of integral shrouds is proposed.

JP-U-63-150002 is presented as an example.

SUMMARY OF THE INVENTION

The conventional example does not consider, in the turbine rotor blade, ensuring an contact surface of a shim provided on a shroud surface with a shroud. In other words, to ensure structural damping between the shim and the shroud, it is necessary to control gap tolerance between the shroud surface and the shim to bring the shroud and the shim into reliable contact with each other.

It is an object of the present invention to provided a steam turbine rotor blade assembly that controls gap tolerance between a shroud surface and a bar-like member to ensure structural damping between the bar-like member and a shroud for reducing vibratory stress, in a structure of inserting a shim or the bar-like member such as a pin or the like between the shroud surfaces.

According to an aspect of the present invention, there is provided a steam turbine rotor blade assembly including: an airfoil; a shroud provided at a tip of the airfoil; a blade root (dovetail) projecting toward an internal circumferential side of a turbine rotor and fitted to a root attachment provided on an outer circumferential portion of the turbine rotor; a platform provided between the airfoil and the blade root; a pin provided between the blade root and the root attachment; a bore formed between respective surfaces of the shrouds facing each other and included in the respective adjacent rotor blades; and a bar-like member provided in the bore.

Preferably, a seal fin is formed at a tip of the shroud.

Preferably, a clearance between the bore and the bar-like member is made greater than clearances between the pin and the blade root and between the pin and the root attachment.

Preferably, the bore is not passed through in the axial direction of the turbine rotor.

Preferably, a portion that is not passes through by the bore is located at respective positions, on the right and left of the shroud, anteroposteriorly facing the steam-flowing direction.

Preferably, the shroud has a portion circumferentially overlapping a shroud adjacent thereto.

Preferably, the shroud whose overlapping portion is located on the downstream side of a steam-flowing direction is bored to receive the bar-like member inserted thereinto.

Preferably, the bar-like member has lower density than that of a blade material forming the shroud.

Preferably, the bar-like member is made of material that is liable to be worn away compared with a blade material forming the shroud.

Preferably, a clearance between the bore and the bar-like member during assembly is made smaller than a difference of displacement between respective bores of the shroud surfaces adjacent to each other, during rotation of a turbine.

Preferably, after being inserted into the bore, the bar-like member is sealed into the bore by caulking a shroud portion at an end of the bore.

According to the present invention, since the pin is provided between the blade root and the root attachment, accuracy of positioning the rotor blade and the rotor is increased. Thus, the gap tolerance between the shroud surface and the bar-like member can be controlled to bring the shroud surface and the bar-like member into reliable contact with each other.

Consequently, the contact area between the shroud and the bar-like member can be increased to enhance structural damping, thereby reducing stress relative to a vibratory load.

DESCRIPTION OF THE PREFERRED EMBODIMENTS

The best mode for carrying out the invention will hereinafter be described by use of specific embodiments.

First Embodiment

Figure 1:
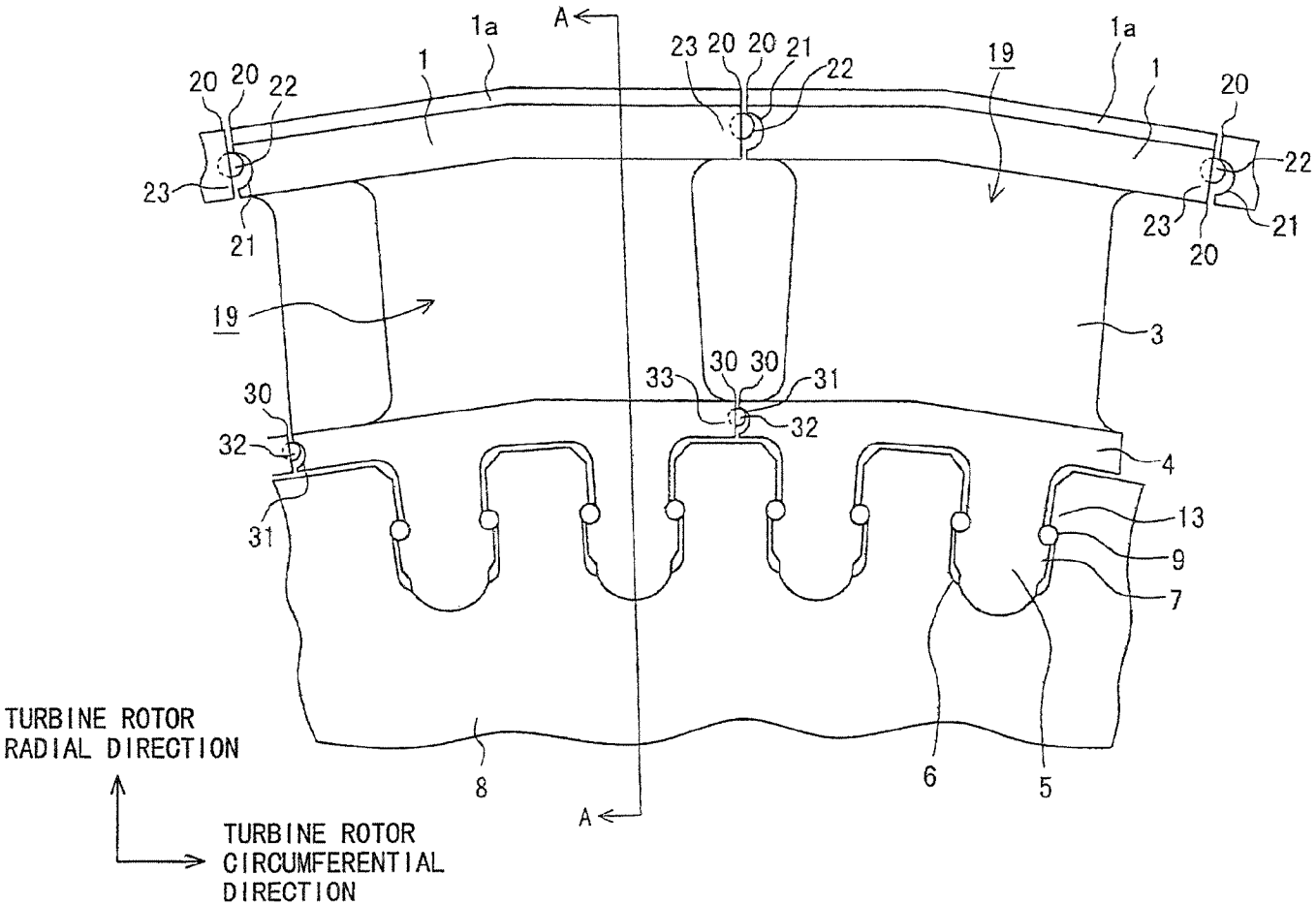
FIG. 1 is a front view of a steam turbine rotor blade according to an embodiment of the present invention, as viewed from the turbine rotor axial direction.
Figure 2:
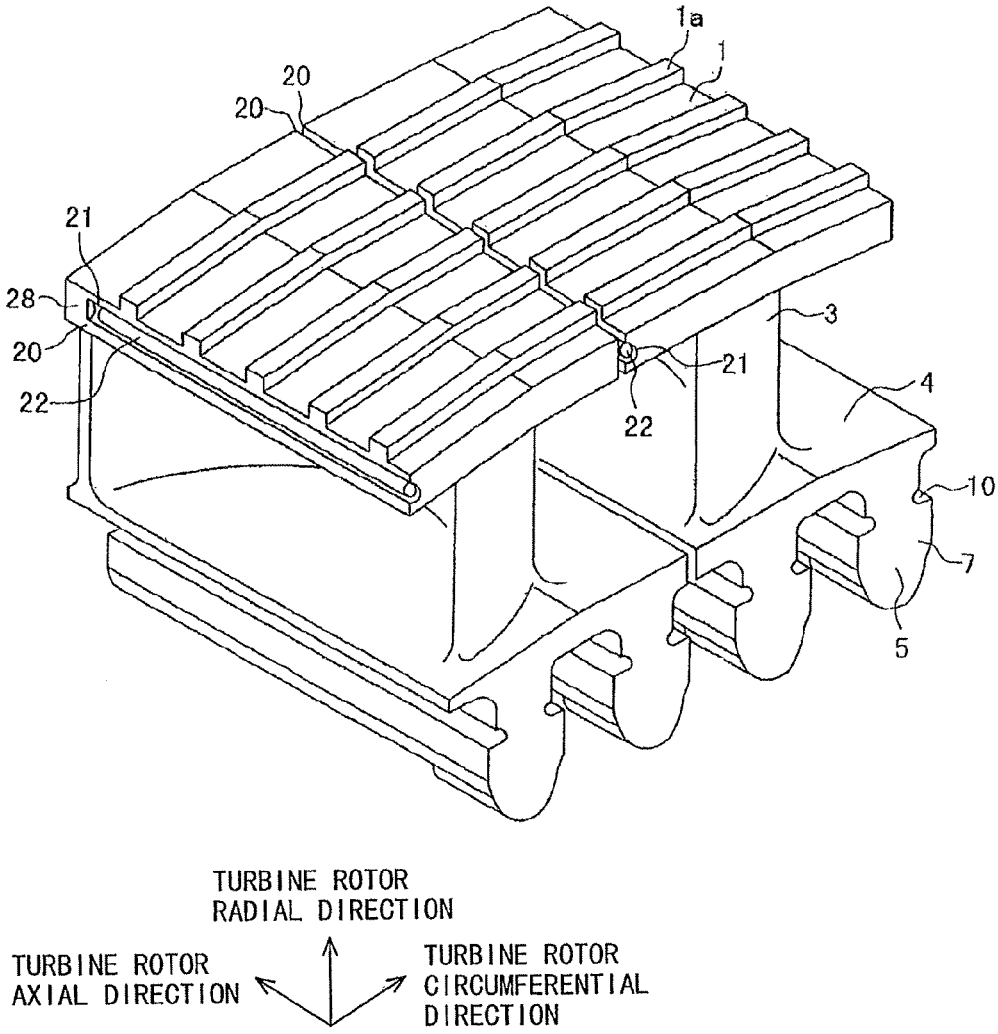
FIG. 2 is a perspective view of the steam turbine rotor blade of the embodiment.

FIG. 1 is a front view of a steam turbine rotor blade according to an embodiment of the present invention as viewed from a turbine rotor axial direction. FIG. 2 is a perspective view of the steam turbine rotor blade.

A steam turbine rotor blade 19 of the first embodiment includes an airfoil 3; a shroud 1 provided at a tip of the airfoil 3; a labyrinth seal 1*a* disposed at a tip of the shroud 1; blade roots 5 each projecting toward the radially inner circumferential side of a turbine rotor 8 and fitted to a root attachment 6 provided on the outer circumference of a turbine rotor; and a platform 4 provided between the airfoil 3 and the blade roots 5. The rotor blade 19 is implanted into the root attachments 6 in the axial direction of the turbine rotor.

The blade root 5 includes a blade root hook 7, and the root attachment 6 of the turbine rotor includes a root attachment hook 13. A bore is provided at a contact portion of the blade root hook 7 of the blade root 5 and the root attachment hook 13 of the root attachment 6 of the turbine rotor. The bore is adapted to receive a fixing pin 9 inserted thereinto toward the turbine rotor axial direction to straddle the blade root hook 7 and the root attachment hook 13.

With this structure, the steam turbine rotor blade 19 is implanted into the root attachments 6 of the turbine rotor 8 and thereafter the fixing pin 9 is inserted into the bore. Thus, the steam turbine rotor blade 19 can accurately be fixed in the circumferential and radial directions of the turbine rotor.

The turbine rotor blade 19 of the present invention is formed with a bore 21 between shroud faces 20, 20 each facing a corresponding adjacent blade. The bore 21 receives a bar-like member 22 therein. The bar-like member 22 is fitted into the bore 21 so as to define a clearance therebetween. The bar-like member 22 is pressed against the upper surface of the bore 21 by a centrifugal force caused on the steam turbine rotor blade 19 due to rotation of the turbine rotor.

Thus, the steam turbine rotor blade 19 is connected to a steam turbine rotor blade adjacent thereto at the bore 21 of the shroud surfaces via the bar-like member 22. The connection between the adjacent rotor blades 19 via the bar-like member 22 in the bore 21 of the shroud surfaces is caused by a friction force acting between the bore 21 and the bar-like member 22 with respect to the circumferential direction of the rotor blade and to the axial direction of the turbine.

For this reason, when the turbine rotor blade 19 is subjected to a vibratory load resulting from steam to vibrate, slip occurs on a contact surface of the bar-like member 22 with the bore 21 of the shroud surfaces to cause structural damping, thereby reducing vibratory stress occurring in the turbine rotor blade.

The contact state between the bore 21 and the bar-like member 22 is important in order to improve such structural damping. More specifically, it is probable that the increased contact area between the bore 21 and the bar-like member 22 decays kinetic energy of the turbine rotor blade 19 resulting from a vibratory load, thereby increasing an effect of reducing vibratory stress.

In the present invention, the steam turbine rotor blade 19 can be secured accurately in the circumferential and radial directions of the turbine rotor by being implanted into the root attachments 6 of the turbine rotor and then by inserting the fixing pin 9 into the bore. In this state, the rotor blade 19 is connected with another rotor blade adjacent thereto via the bar-like member 22 at the bore 21 of the shroud surfaces. Thus, the gap tolerance between the bore 21 of the adjacent blades 21 and the bar-like member 22 can be controlled, and the contact area between the bore 21 of the adjacent rotor blades and the bar-like member 22 can be increased.

In this way, the structural damping between the bore 21 of the adjacent rotor blades and the bar-like member 22 can be improved to reduce vibratory stress relative to a vibratory load.

Additionally, the clearance between the bore 21 of the shroud surfaces 20 and the bar-like member 22 is made equal to or greater than the clearance between the blade root and the fixing pin 9 and between the root attachment and the fixing pin 9. This can prevent the lowering of structural damping resulting from the fact that the bore 21 of the shroud surfaces 20 and the bar-like member 22 are engaged with each other so that the adjacent shrouds 1 are rigidly connected with each other. In addition, this can prevent the high-stress of the shroud 1 and of the bore 21 caused by restraining the deformation difference between the adjacent rotor blades.

In FIGS. 1 and 2, a bore seal 23 is provided so that the bar-like member 22 provided in the bore 21 may not fall out of the bore 21 and so that the bore provided in the shroud may not be passed therethrough in the rotor-axial direction. The bore seals 23 are provided at respective positions, on the right and left of the shroud, anteroposteriorly facing the steam-flowing direction. In addition, the steam turbine rotor blade 19 and the bar-like member 22 are sequentially assembled. Thus, the bar-like member 22 can be sealed in the bore 21 provided in the shroud surfaces 20.

Incidentally, a final rotor blade forming a blade ring is formed with a through-hole, which needs to be sealed. Sealing the through-hole may be done by welding, a screw, caulking or the like.

The bore 21 of the shroud surfaces 20 may be a through-hole. In this case, the bar-like member 22 is prevented from falling out of the through-hole by caulking the bore 21 or the bar-like member 22 or by sealing the through-hole by welding or with a screw.

In order to increase structure damping, the steam turbine rotor blade 19 is implanted into the root attachments 6 of the turbine rotor and then the fixing pin 9 is inserted to secure the rotor blade 19 in the circumferential and radial directions of the turbine rotor. Thereafter, the bore 21 of the shroud surfaces 20 may be processed.

In this way, the contact area between the bore 21 and the bar-like member 22 is increased and the bore 21 and the bar-like member 22 can be brought into the contact state that improves the structural damping.

Figure 3:
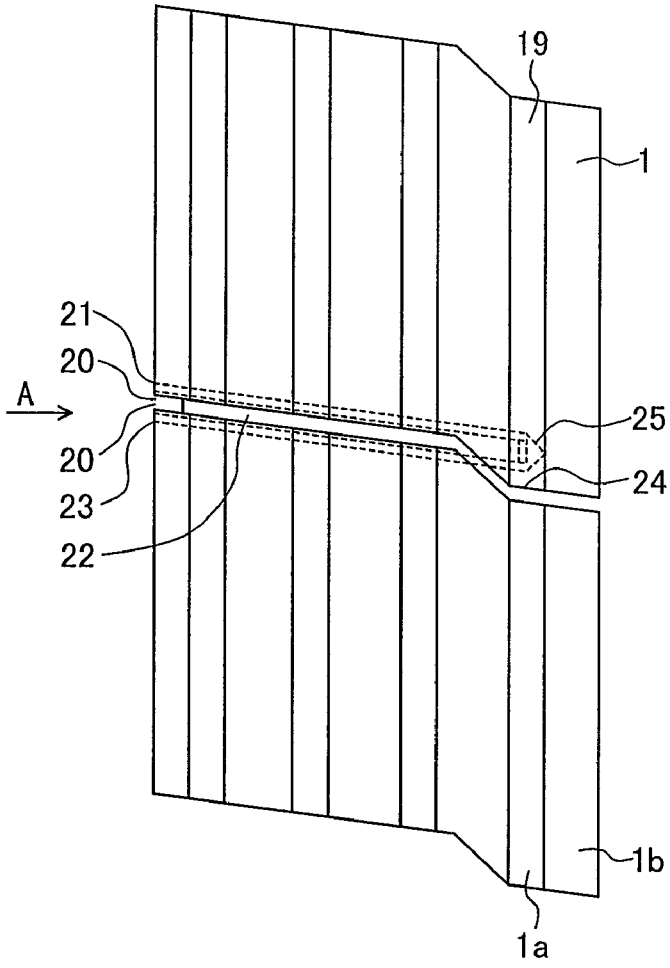
FIG. 3 illustrates shrouds of steam turbine rotor blades according to another embodiment of the present invention.

FIG. 3 illustrates another embodiment of the present invention. A shroud 1 is formed with a section 24 circumferentially overlapping a shroud 1*b* adjacent thereto. The provision of the overlapping section 24 can prevent a bar-like member 22 from falling out in the steam-flowing direction.

A bore 25 formed at the overlapping section 24 is circular.

In this way, when inserted between the shrouds 1 adjacent to each other, the bar-like member 22 is previously inserted into the circular bore 25 for retainment. The shroud 1*b* of an adjacent rotor blade can thereafter be installed. In addition, assembly performance can be enhanced.

Figure 4:
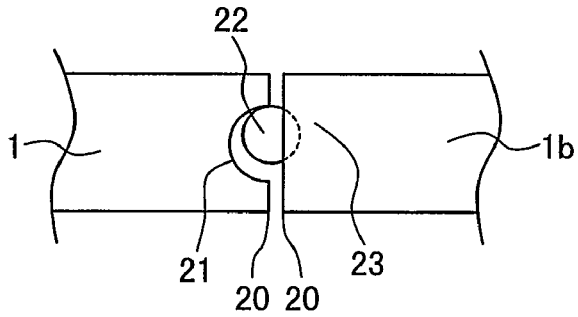
FIG. 4 illustrates the shrouds of FIG. 3, as viewed from arrow A.

FIG. 4 illustrates the embodiment of FIG. 3 as viewed from arrow A. As with the embodiment of FIGS. 1 and 2, the bar-like member 22 can be prevented from falling out by a bore seal 23.

Figure 5:
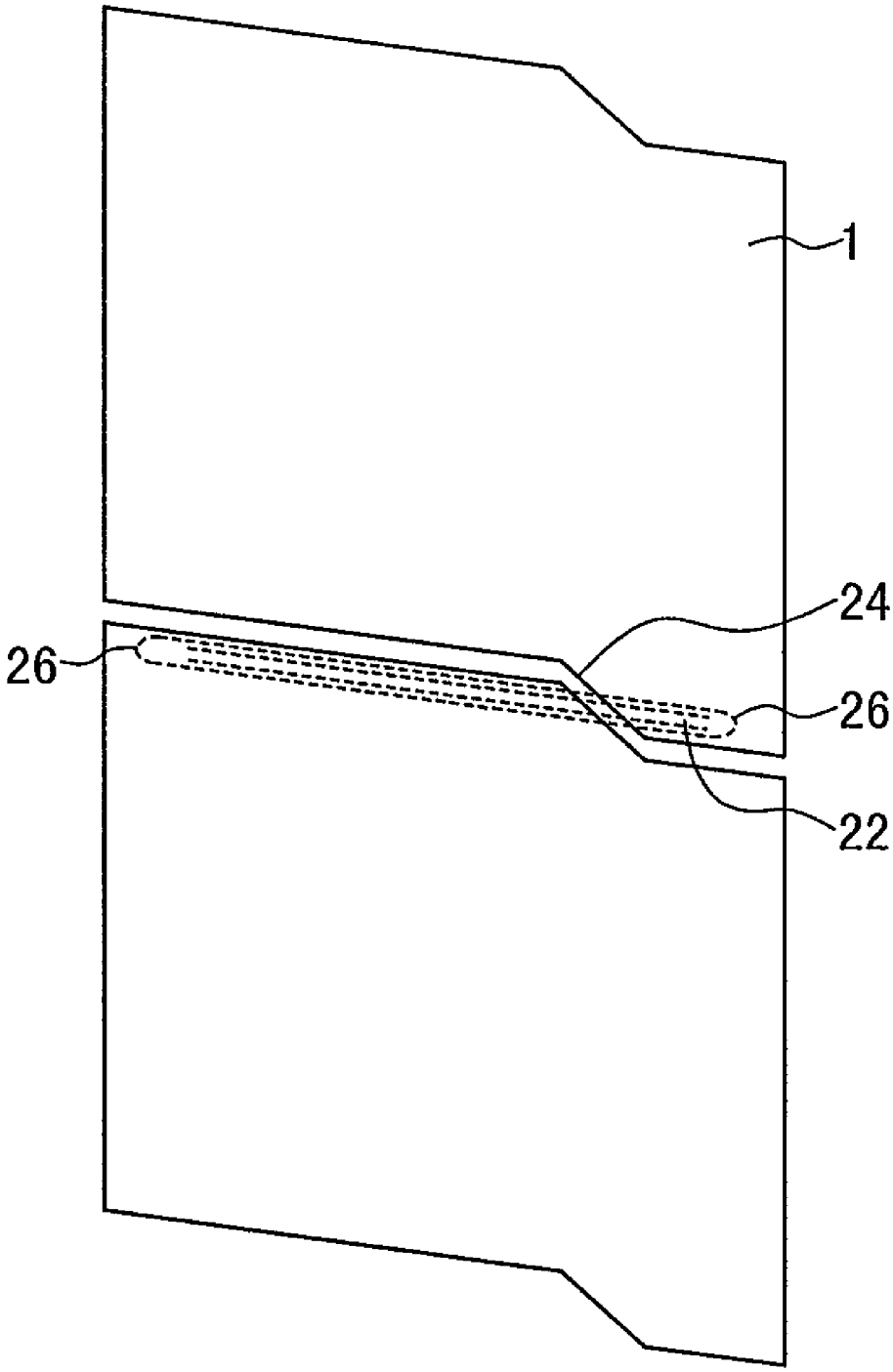
FIG. 5 illustrates shrouds of steam turbine rotor blades according to another embodiment of the present invention.

FIG. 5 illustrates another embodiment of the present invention. A shroud is provided with a section 24 circumferentially overlapping a shroud adjacent thereto and additionally the bore 21 mentioned above is formed as a circular bore 26 which has no section opening toward an adjacent shroud surface 20. Thus, the circular bore 26 that can seal the bar-like member 22 therein can be provided so that stress caused around the bore of the shroud 1 by a centrifugal force or by force transmitted from the bar-like member 22 can be reduced.

Referring again FIG. 1, in order to provide the same effect as that of the bar-like member 22 provided in the shrouds 1, a bar-like member 32 may be sealed in a bore 31 provided between respective adjacent surfaces 30, 30 of platforms 4. A sealing section 33 is similarly constructed to prevent the bar-like member 32 from falling out.

In the embodiments shown in FIGS. 1 through 5, the hardness of the internal surface of the bore 21 or of the circular bore 26 is made higher than that of the bar-like member 22. This can provide the following effect.

It is possible to prevent the inner surface of the bore 21 or of the circular bore 26 from being worn away by the bar-like member 22 so that otherwise the bar-like member 22 falls out.

Examples of methods for increasing the hardness of the inner surface of the bore 21 or of the circular bore 26 conceivably include hard chrome plating, nitriding, curburizing, induction hardening and other processing.

In addition, the material of the bar-like member 22 is light metal such as e.g. a Ti alloy or an Al alloy. This can reduce stress occurring on the inner surface of the bore 21 or of the circular bore 26.

Figure 6:
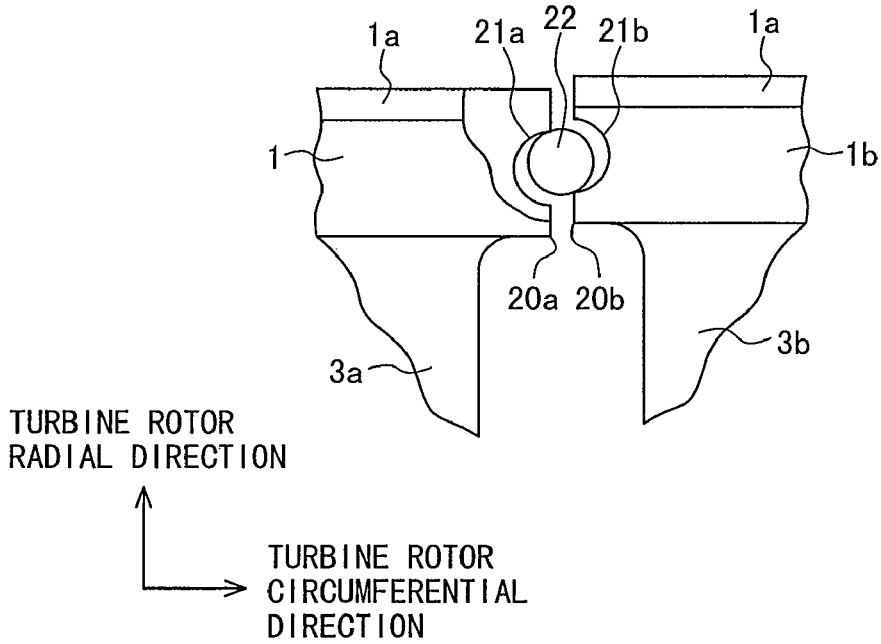
FIG. 6 is a diagram for assistance in explaining the positional relationship between a bar-like member and respective bores of shroud surfaces during rotation of a turbine.
Figure 7:
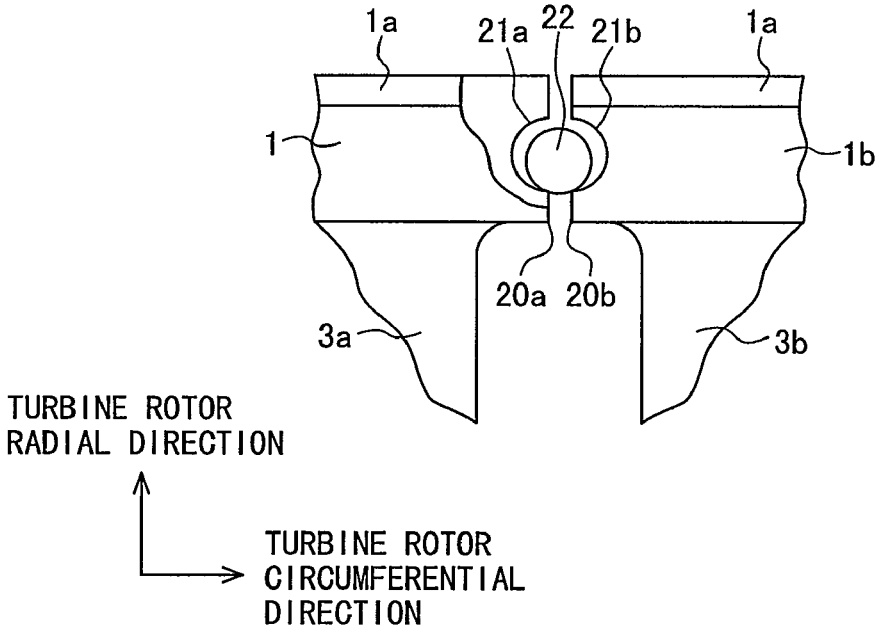
FIG. 7 is a diagram for assistance in explaining the positional relationship between the bar-like member and the respective bores of the shroud surfaces during rotation-stoppage or assembly.

FIGS. 6 and 7 are diagrams for assistance in explaining another embodiment of the present invention. FIG. 6 is a diagram for assistance in explaining the positional relationship between a bar-like member 22 and each of respective bores 21*a*, 21*b* of shroud surfaces 20*a*, 20*b* facing each other and included in respective adjacent rotor blades, during rotation of a turbine.

In the present embodiment, a clearance between the bar-like member 22 and each of the respective bores 21*a*, 21*b* of the shroud surfaces 20*a*, 20*b* facing each other and included in the adjacent rotor blades is made smaller than a difference of displacement between the respective bores 21*a*, 21*b* of the adjacent shroud surfaces 20*a*, 20*b* during rotation of the turbine. In this way, as shown in FIG. 6, during rotation of the turbine, the bar-like member 22 comes into contact with an upper portion of the bore 21*a* of the shroud surface 20*a* and simultaneously with a lower portion of the bore 21*b* of the shroud surface 20*b*. Consequently, the turbine rotor blade 19 is connected with a turbine blade adjacent thereto via the bar-like member 22 at the bores 21*a*, 21*b* of the shroud surfaces. The connection between the adjacent rotor blades 19 via the bar-like member 22 at the bores 21*a*, 21*b* of the shroud surfaces is caused by a friction force acting between the bore 21 and the bar-like member 22 with respect to the circumferential direction of the rotor blade and to the axial direction of the turbine.

In FIG. 6, the shroud 1 undergoes less turbine-radial deformation than the shroud 1*b*. In general, the shroud located on the rear side (the suction side) of the rotor blade undergoes less deformation whereas the shroud located on the ventral side (the pressure side) of the rotor blade undergoes larger deformation.

FIG. 7 is a diagram for assistance in explaining the positional relationship between the bar-like member 22 and the respective bores 21*a*, 21*b* of the shroud surfaces 20*a*, 20*b* facing each other and included in the respective adjacent rotor blades, during rotation-stoppage or assembly. During rotation-stoppage or assembly, a clearance is defined between the bar-like member 22 and each of the respective bores 21*a*, 21*b* of the shroud surfaces included in the respective adjacent rotor blades. Because of this clearance, the bar-like member 22 can freely move in the bores 21*a*, 21*b* so as not to connect the rotor blades with each other as a mechanically stiff structure. With such a configuration, the bores 21*a* and 21*b* are provided in the shroud surfaces 20*a* and 20*b*, respectively, and thereafter, the bar-like member 22 can easily be inserted into the bores 21*a*, 21*b*.

Figure 8:
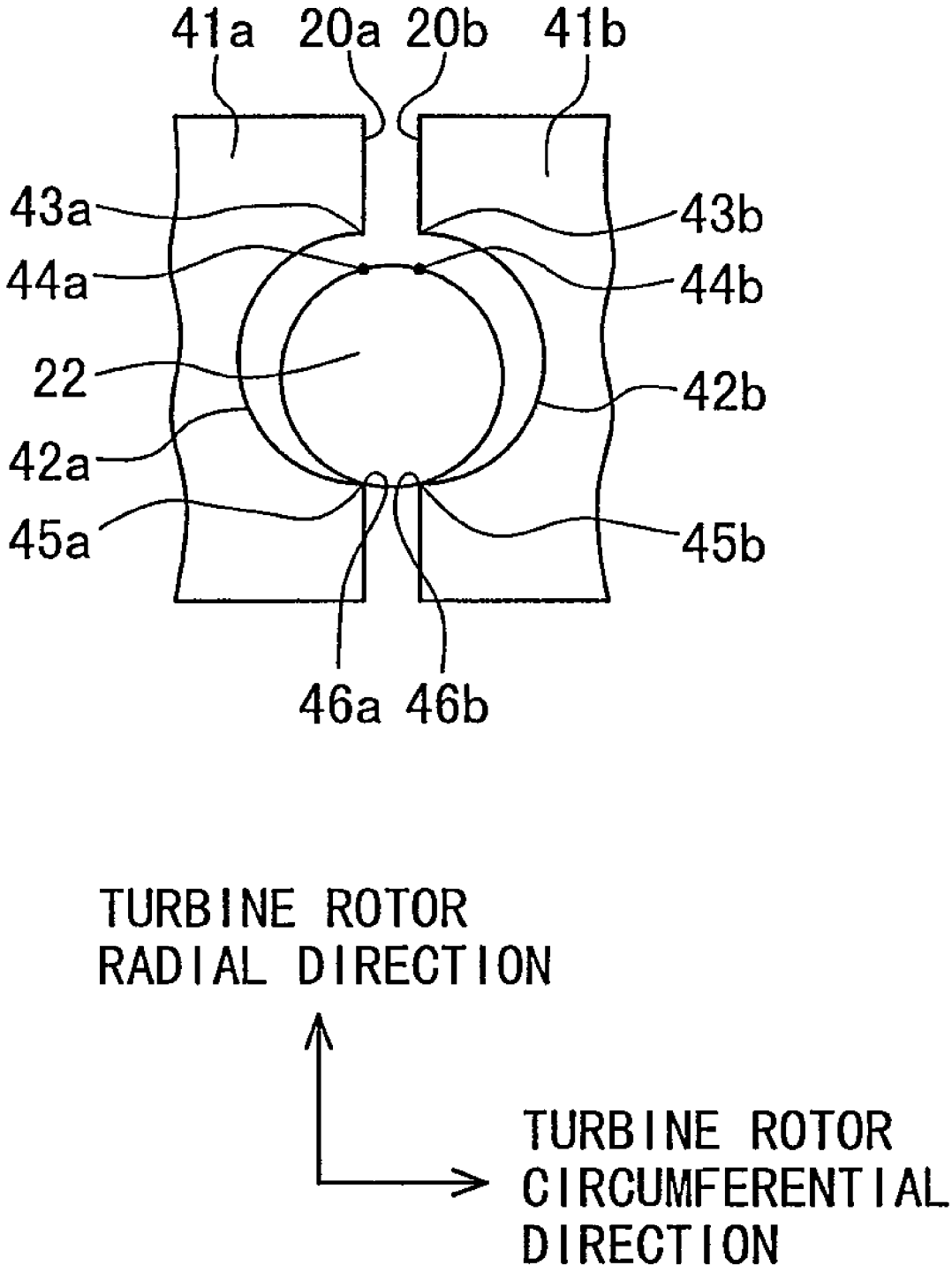
FIG. 8 illustrates details of setting of the bores of the shrouds and the bar-like member during assembly.

FIG. 8 illustrates details of setting of the bores of the shrouds and the bar-like member 22 during assembly. First, a distance between a point 43*a* and a point 44*a* is assumed as Ga. The point 43*a* is located on the inner circumference of the bore 42*a* of the shroud surface 20*a* and on the outer circumference of the rotor blade. The point 44*a* is located on the bar-like member 22 at a position corresponding to the outer circumference of the rotor blade, facing the point 43*a* on the inner circumference of the bore 42*a*, and probably coming into contact with the point 43*a* during operation. Similarly, a distance between a point 43*b* and a point 44*b* is assumed as Gb. The point 43*b* is located on the inner circumference of the bore 42*b* of the shroud surface 20*b* and on the outer circumference of the rotor blade. The point 44*b* is located on the bar-like member 22 at a position corresponding to the outer circumference of the rotor blade, facing the point 43*b* on the inner circumference of the bore 42*b*, and probably coming into contact with the point 43*b* during operation.

During turbine operation, the shrouds 41*a*, 41*b* cause a difference of displacement in the turbine rotor radial direction due to a difference in deformation volume resulting from a centrifugal force and to a difference in thermal deformation. Consequently, also the points 43*a*, 43*b* cause a difference of displacement in the turbine rotor radial direction. This difference is assumed as U43. Similarly, the point 45*a* on the inner circumference of the bore 42*a* provided in the shroud 41*a* and the point 45*b* on the inner circumference of the bore 42*b* provided in the shroud 41*b* causes a difference of displacement in the turbine rotor radial direction. This difference is assumed as U45. In this case, as represented by the following expressions, the clearances Ga and Gb between the bar-like member 22 and the bore 42*a* of the shroud surface 20*a* and between the bar-like member 22 and the bore 42*b* of the shroud surface 20*b*, respectively, are made smaller than the corresponding differences of displacement of the bores included in the shroud surfaces adjacent to each other during turbine rotation.

$|Ga|<|U43|$ $|Gb|<|U43|$ $|Ga|<|U45|$ $|Gb|<|U45|$

As a result, during turbine operation, if the shroud 41*b* has displacement greater than that of the shroud 41*a*, the bar-like member 22 comes into contact with an upper portion of the bore 42*a* of the shroud 22 and simultaneously with a lower portion of the bore 42*b* of the shroud 41*b* during turbine rotation.

It is probable that the differences of displacement U43, U45 of the adjacent shrouds resulting from a centrifugal force are each on the order of hundreds of μm in the turbine used in industry. If the cross-section of the bar-like member 22 is made circular, the clearance between the bar-like member 22 and each of the bores 42*a*, 42*b* can be reduced to as small as several μm to tens of μm. For this reason, as shown in above expressions, the clearances Ga and Gb between the bar-like member 22 and the bore 42*a* provided in the shroud surface and between the bar-like member 22 and the bore 42*b* provided in the shroud surface can sufficiently be made smaller than the differences of displacement U43, U45 of the adjacent shrouds during the operation.

It is probable that the differences of displacement U43, U45 of the shrouds during operation increase as the square of rotation speed. In the present invention, it is natural that the bores 42*a*, 42*b* and the bar-like member 22 come into contact with each other at a rated speed to connect the shrouds with each other. However, it is preferable that Ga and Gb be set so that the bores 42*a*, 42*b* and the bar-like member 22 may come into contact with each other at 10% to 20% of the rated speed to connect the shrouds with each other. In this case, the differences of displacement U43, U45 of the adjacent shrouds can accurately be obtained by finite element analysis. Thus, the clearances Ga and Gb between the bar-like member 22 and the bore 42*a*, and between the bar-like member 22 and the bore 42*b* may each need to be set to a numerical value including some safety factor to the corresponding difference of displacement obtained.

Figure 9:
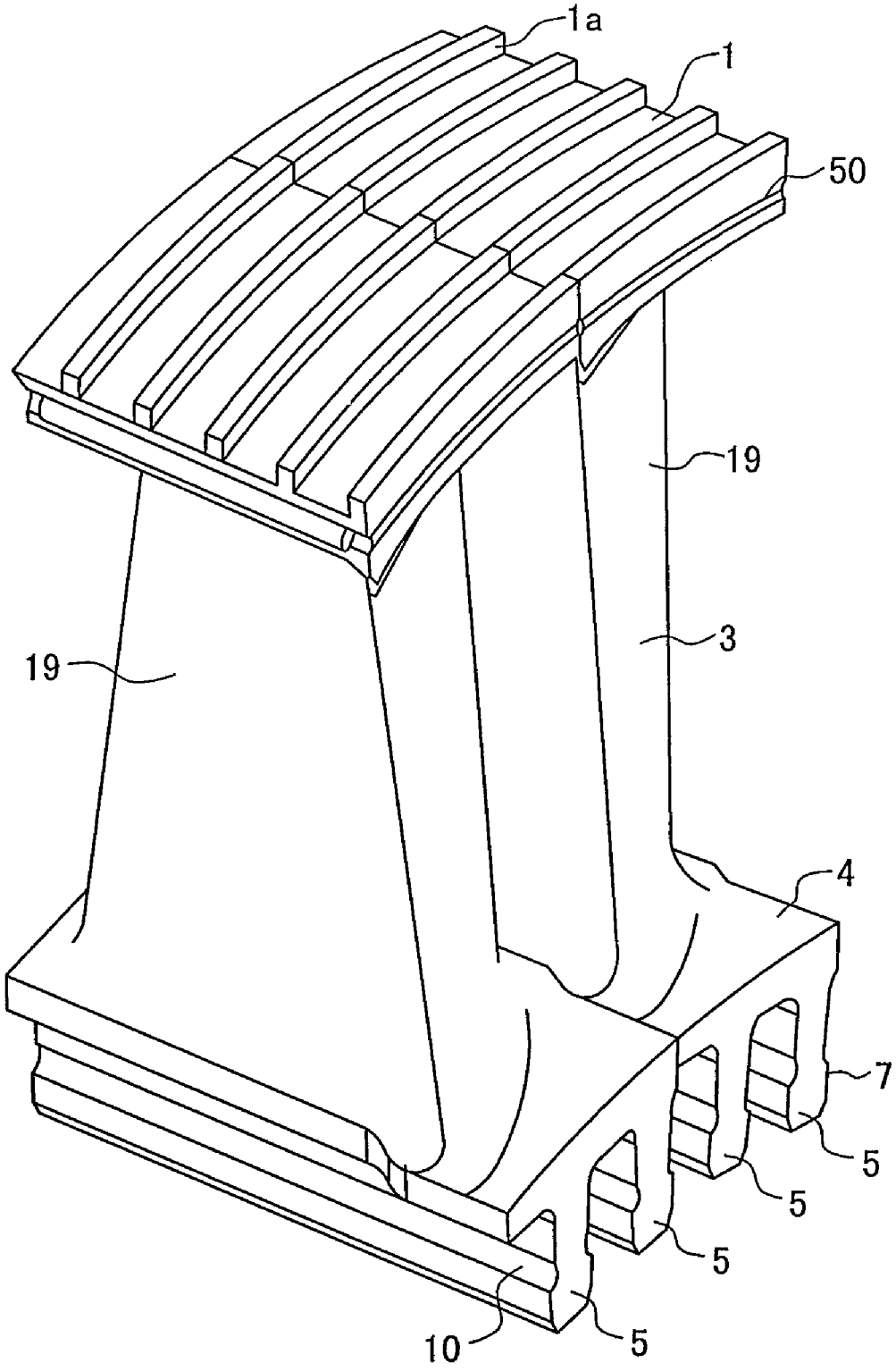
FIG. 9 is a perspective view of a steam turbine rotor blade according to another embodiment of the present invention.

To seal the bar-like member 22 into the bores 42*a*, 42*b*, as shown in FIG. 9, the bar-like member 22 is inserted into the bores 42*a*, 42*b*, and thereafter, the end faces of the bores are caulked by a roller or a punch to form a plastically deformation 50, which prevents the bar-like member from falling out.

As shown in FIG. 1, the bore 31 is provided in the adjacent surfaces 30 of the platforms 4, and the bar-like member 32 is sealed into the bore 31. Also in such a case, the effect of the present invention can further be improved by setting the same clearances as those between each of the bores 21 of the shrouds and the bar-like member 22 and by connecting the platforms 4 with each other.

The embodiment of FIGS. 6 through 9 describes the steam turbine provided with the pin between the blade root of the turbine blade and the root attachment. However, the present embodiment may be applied to a turbine blade not provided with the pin on the root attachment but having a Christmas tree type dovetail. The present invention can be applied to a turbine blade used for a steam turbine, a gas turbine, a compressor or a blower.

What is claimed is:

1. A steam turbine rotor blade assembly comprising:

an airfoil;

a shroud provided at a tip of the airfoil;

a blade root projecting toward a radially internal circumferential side of a turbine rotor and fitted to a root attachment provided on an outer circumferential portion of the turbine rotor;

a platform provided between the airfoil and the blade root;

a pin provided between the blade root and the root attachment;

a bore formed between respective surfaces of the shrouds facing each other and included in the respective adjacent rotor blades; and a bar-like member provided in the bore with a clearance formed between the bore and the bar-like member;

wherein a clearance between the bore and the bar-like member during assembly is made smaller than a difference of displacement in the radial direction between respective bores of the shroud surfaces adjacent to each other, during rotation of a turbine.

2. The steam turbine rotor blade assembly according to claim 1, wherein a seal fin is formed on a tip of the shroud.

3. The steam turbine rotor blade assembly according to claim 1, wherein the clearance between the bore and the bar-like member is made equal to or greater than clearances between the pin and the blade root and between the pin and the root attachment.

4. The steam turbine rotor blade assembly according to claim 1, wherein the bore is not passed through in the axial direction of the turbine rotor.

5. The steam turbine rotor blade assembly according to claim 4, wherein a portion that is not pass through by the bore is located at respective positions, on the right and left of the shroud, anteroposteriorly facing a steam-flowing direction.

6. The steam turbine rotor blade assembly according to claim 1, wherein the shroud has a portion circumferentially overlapping another shroud adjacent thereto.

7. The steam turbine rotor blade assembly according to claim 6, wherein the shroud whose overlapping portion is located on the downstream side of a steam-flowing direction is bored to receive the bar-like member inserted thereinto.

8. The steam turbine rotor blade assembly according to claim 1, the bar-like member has lower density than that of a blade material forming the shroud.

9. The steam turbine rotor blade assembly according to claim 1, wherein the bar-like member is made of material that is liable to be worn away compared with a blade material forming the shroud.

10. A steam turbine rotor blade assembly comprising:

an airfoil;

a shroud provided at a tip of the airfoil;

a blade root projecting toward a radially internal circumferential side of a turbine rotor and fitted to a root attachment provided on an outer circumferential portion of the turbine rotor;

a platform provided between the airfoil and the blade root;

a bore formed between respective surfaces of the shrouds facing each other and included in the respective adjacent rotor blades; and a bar-like member provided in the bore with a clearance formed between the bore and the bar-like member;

wherein the clearance between the bore and the bar-like member during assembly is made smaller than a difference of displacement in the radial direction between respective bores of the shroud surfaces adjacent to each other, during rotation of a turbine.

11. The steam turbine rotor assembly according to claim 10, wherein after being inserted into the bore, the bar-like member is sealed into the bore by caulking a shroud portion at an end of the bore.

* * * * *